US006039224A

United States Patent [19]

Dallas, Jr. et al.

[11] Patent Number: 6,039,224

[45] Date of Patent: Mar. 21, 2000

[54] MULTIPLE-ORIFICE DISPENSING SYSTEM WITH IMPROVED SEAL

[75] Inventors: Milton R. Dallas, Jr., East Troy; Jeffrey T. Randall, Oconomowoc, both of Wis.

[73] Assignee: Aptar Group, Inc., Crystal Lake, Ill.

[21] Appl. No.: 09/213,168

[22] Filed: Dec. 17, 1998

[51] Int. Cl.[7] ..... A47G 19/24

[52] U.S. Cl. ..... 222/565; 222/556; 222/546; 222/480

[58] Field of Search ..... 222/565, 556, 222/546, 480, 482, 483, 484, 485

[56] References Cited

U.S. PATENT DOCUMENTS

| | | | |
|---|---|---|---|
| 2,753,051 | 7/1956 | Tupper . | |
| 3,059,816 | 10/1962 | Goldstein . | |
| 3,220,618 | 11/1965 | Lodding et al. | 222/484 |
| 3,223,297 | 12/1965 | Nyden . | |
| 3,237,816 | 3/1966 | Anderson . | |
| 3,240,405 | 3/1966 | Abbott . | |
| 3,250,428 | 5/1966 | Rieke . | |
| 3,319,842 | 5/1967 | Miller . | |
| 3,693,847 | 9/1972 | Gibson . | |
| 3,927,805 | 12/1975 | Stull . | |
| 3,986,627 | 10/1976 | Zapp . | |
| 4,220,248 | 9/1980 | Wilson et al. . | |
| 4,369,901 | 1/1983 | Hidding . | |
| 4,545,508 | 10/1985 | Cribb, Jr. et al. | 222/482 X |
| 4,638,916 | 1/1987 | Beck et al. . | |
| 4,723,669 | 2/1988 | Barriac . | |
| 4,735,334 | 4/1988 | Abbott . | |
| 4,739,906 | 4/1988 | LoTurco . | |
| 4,749,108 | 6/1988 | Dornsbusch et al. . | |
| 4,778,071 | 10/1988 | Fillmore . | |
| 4,795,044 | 1/1989 | Beck . | |
| 4,801,054 | 1/1989 | Nycz | 222/545 |
| 4,807,769 | 2/1989 | Gach . | |
| 4,895,282 | 1/1990 | Robinson . | |
| 5,094,361 | 3/1992 | Dubach . | |
| 5,141,138 | 8/1992 | Odet et al. . | |
| 5,271,431 | 12/1993 | Rohr et al. . | |
| 5,356,018 | 10/1994 | Dubach . | |
| 5,390,805 | 2/1995 | Bilani et al. . | |
| 5,620,107 | 4/1997 | Takeuchi . | |
| 5,642,824 | 7/1997 | Hess, III et al. . | |
| 5,769,277 | 6/1998 | Elliott . | |
| 5,779,110 | 7/1998 | Brown et al. . | |

*Primary Examiner*—Joseph A. Kaufman
*Assistant Examiner*—Thach Bui
*Attorney, Agent, or Firm*—Rockey, Milnamow & Katz, Ltd.

[57] ABSTRACT

A dispensing structure is provided for a container that has an opening from which a product can be dispensed. The structure includes a body for extending around the container opening. The body is provided with a plurality of dispensing apertures. A lid is provided for sealingly occluding the foraminous member and for moving between a closed position and an open position. The lid has two spaced-apart sealing walls for sealing the sides of the body channel over the dispensing apertures.

20 Claims, 10 Drawing Sheets

MULTIPLE-ORIFICE DISPENSING SYSTEM WITH IMPROVED SEAL

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a system for dispensing product from a container. The invention is more particularly related to a sealable closure system that can be opened to facilitate dispensing of a particulate material such as a powder or granular substance.

BACKGROUND OF THE INVENTION AND TECHNICAL PROBLEMS POSED BY THE PRIOR ART

A variety of packages, including dispensing packages or containers, have been developed for particulate materials, including cosmetic products such as powders and including food products such as herbs, spices, granular salt, etc., as well as other materials. Such containers typically have an open upper end on which is mounted a closure.

One type of dispensing closure for containers includes a base having many small dispensing holes and a lid mounted to the base for covering the holes. When the user opens the lid and inverts and shakes the container, the product particles are sprinkled out through the holes.

While the above-described type of container closure functions generally satisfactorily, it would be desirable to provide an improved dispensing structure for containers. With some types of prior art closures, multiple dispensing holes are individually occluded with separate plugs on the underside of the closed lid. See, for example U.S. Pat. No. 4,369,901. Such a structure may be difficult to manufacture so as to provide ease of closure and reliable sealing of each hole when the lid is moved to the closed position.

If the individual plugs were eliminated so as to simplify manufacture and make the closing process easier, then the particulate material could pass through the holes under the closed lid and accumulate on portions of the closure under the lid. Then, when the lid is subsequently opened, the accumulated material outside of the holes becomes visible and is not aesthetically pleasing. Further, as the lid is moved to the open position, some of the accumulated material may get knocked off of, or thrown outwardly from, the closure.

Thus, it would be desirable to provide an improved dispensing structure which could substantially eliminate or lessen the accumulation of product adjacent the exterior of the dispensing holes.

Further, it would be desirable if such an improved dispensing structure could employ a lid sealing system which would function more reliably to preserve the freshness of the product in the container when the dispensing structure is in a closed condition.

It would also be advantageous if such an improved dispensing structure could accommodate individual dispensing holes having a variety of shapes.

It would also be desirable if such an improved dispensing structure could provide more consistent opening and closing resistance forces.

It would also be beneficial if such an improved dispensing structure could accommodate use of a variety of different materials. Further, it would be desirable if such an improved dispensing structure could be provided with a design that would accommodate efficient, high-quality, large volume manufacturing techniques with a reduced product reject rate.

The present invention provides an improved dispensing structure which can accommodate designs having the above-discussed benefits and features.

SUMMARY OF THE INVENTION

According to one aspect of the present invention, a dispensing system or structure is provided for a container that has an opening to the container interior. The dispensing structure includes a body for extending around the container opening. The body defines an end wall. A continuous channel is defined in the end wall at least in part by an outer seal surface and an inner seal surface spaced from the outer seal surface. There are a plurality of spaced-apart dispensing apertures in the channel between the inner and outer seal surfaces.

The structure also includes a lid with a continuous outer seal wall and a continuous inner seal wall spaced from the outer seal wall. The lid is movable between (1) a closed position over both the body end wall wherein (a) the outer seal wall sealingly engages the body outer seal surface, and (b) the inner seal wall sealing engages the body inner seal surface, and (2) an open position away from the closed position to permit dispensing of the product.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 8 shows the closure base or body engaged with a portion of the container designated in phantom with dashed lines;

DESCRIPTION OF THE PREFERRED EMBODIMENT

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

For ease of description, the dispensing structure of this invention is described in the normal (upright) operating position, and terms such as upper, lower, horizontal, etc., are used with reference to this position. It will be understood, however, that the dispensing structure of this invention may be manufactured, stored, transported, used, and sold in an orientation other than the position described.

Figure 1:
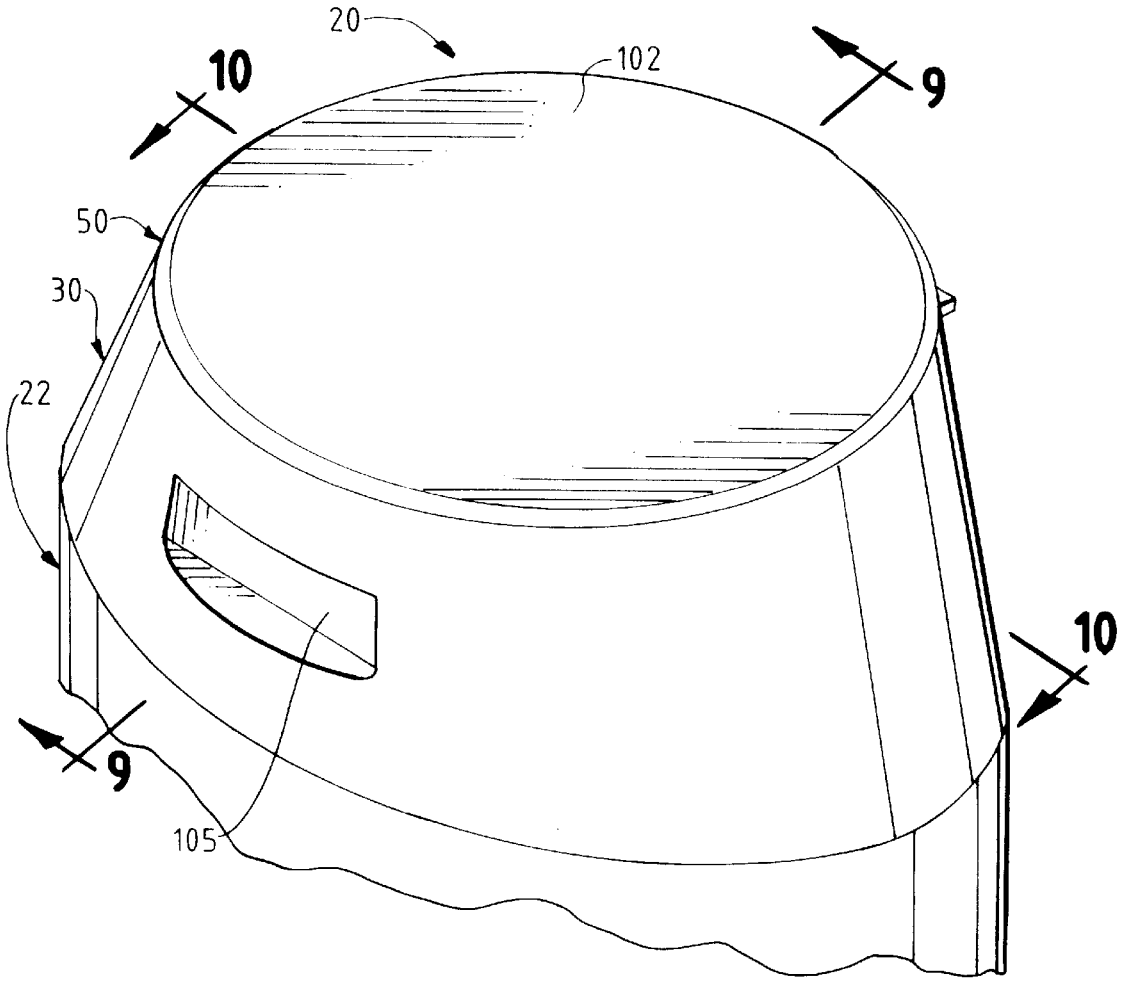
FIG. 1 is a fragmentary, top, perspective view of a preferred embodiment of a dispensing structure of the present invention in the form of a closure in the closed condition removably mounted on a container.
Figure 8:
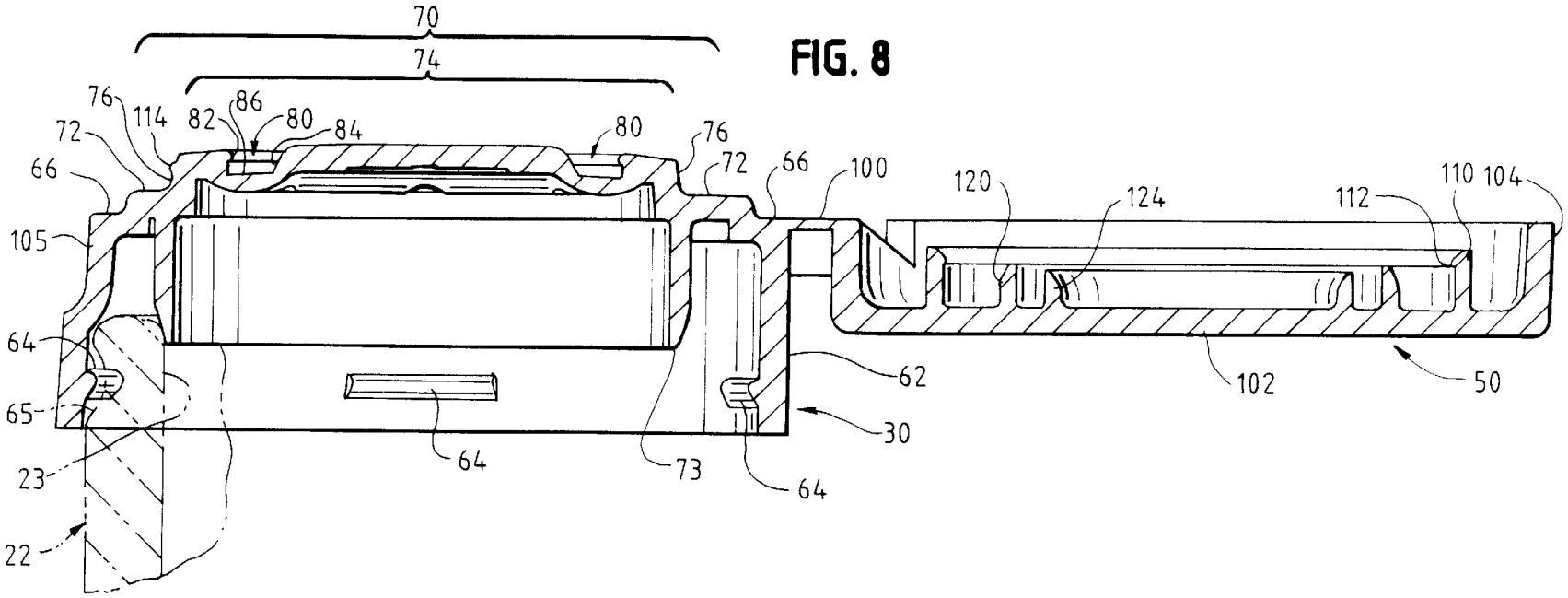
FIG. 8 is a cross-sectional view taken generally along the plane 8—8 in FIG. 5.

A presently preferred embodiment of a dispensing structure or system of the present invention is illustrated in FIGS. 1–11 and is designated generally therein by reference number 20. In the preferred embodiment illustrated, the dispensing structure is provided in the form of a closure 20 which is adapted to be mounted on a container 22 (FIGS. 1 and 8). The body of the container 22 may have any suitable configuration. The container 22 could have an upwardly projecting neck which is adapted to receive the closure 20 and which may have a different cross-sectional shape than the container body.

The container 22 would typically contain a powdered material, granular material, shredded material, or other fine particulate material (e.g., baby power) or coarse particular material (e.g., a ground spice used for food preparation).

The container 22 may have a rigid wall or walls, or the container 22 may have a somewhat flexible wall or walls. The container 22 defines an opening 23 (FIG. 8), typically at the upper end of the container 22 or container neck (if the container has such a neck).

Although the container 22, per se, need not necessarily form a part of the present invention, per se, it will be appreciated that the dispensing structure or system of the present invention may be provided as a unitary portion, or extension, of the top of the container 22. However, in the preferred embodiment illustrated, the dispensing structure 20 is a separate element or closure which is adapted to be mounted to a previously manufactured container 22 which has an opening to the container interior.

Figure 2:
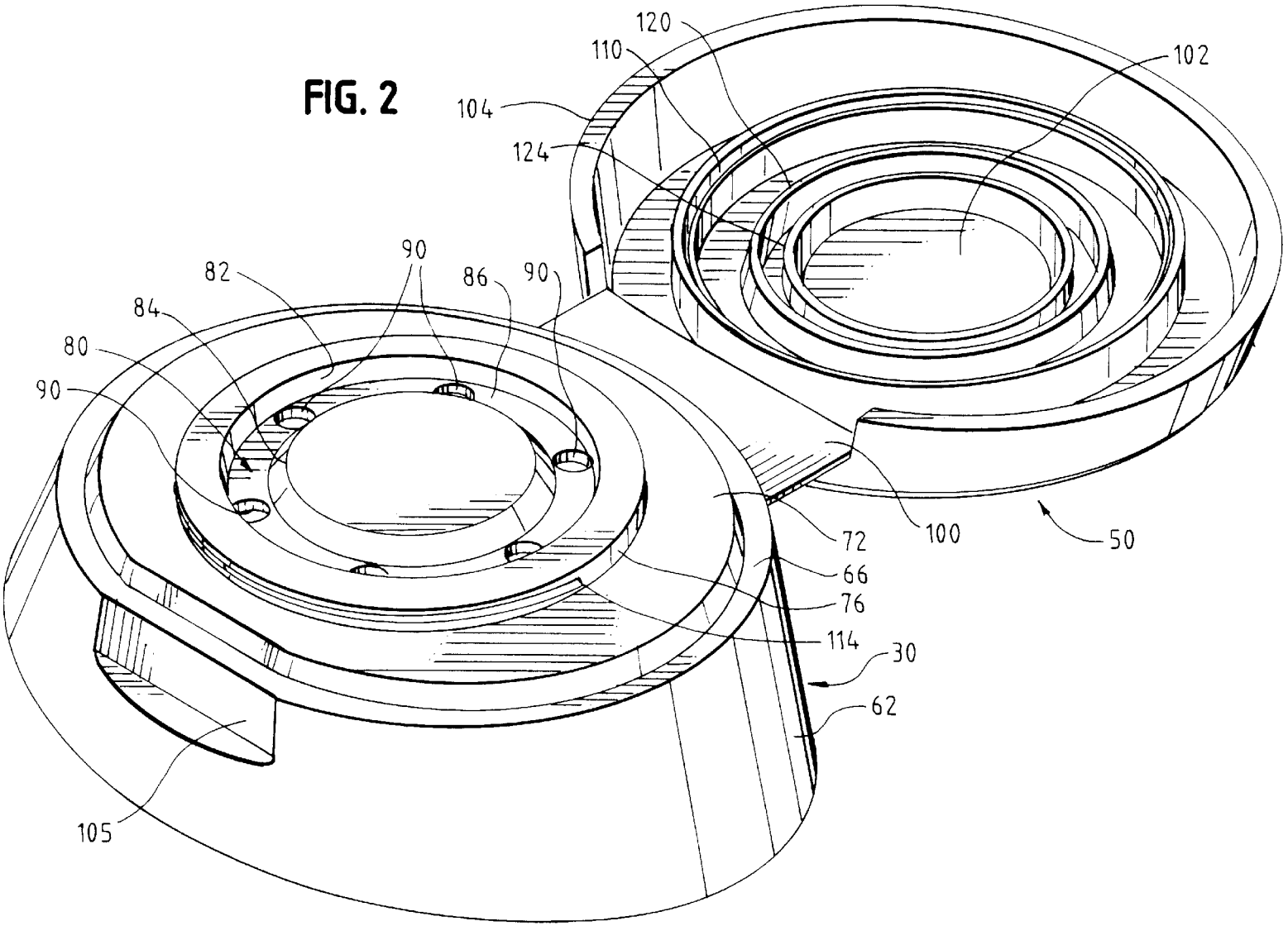
FIG. 2 is a top, perspective view of the dispensing closure shown in the open position with the container omitted.
Figure 3:
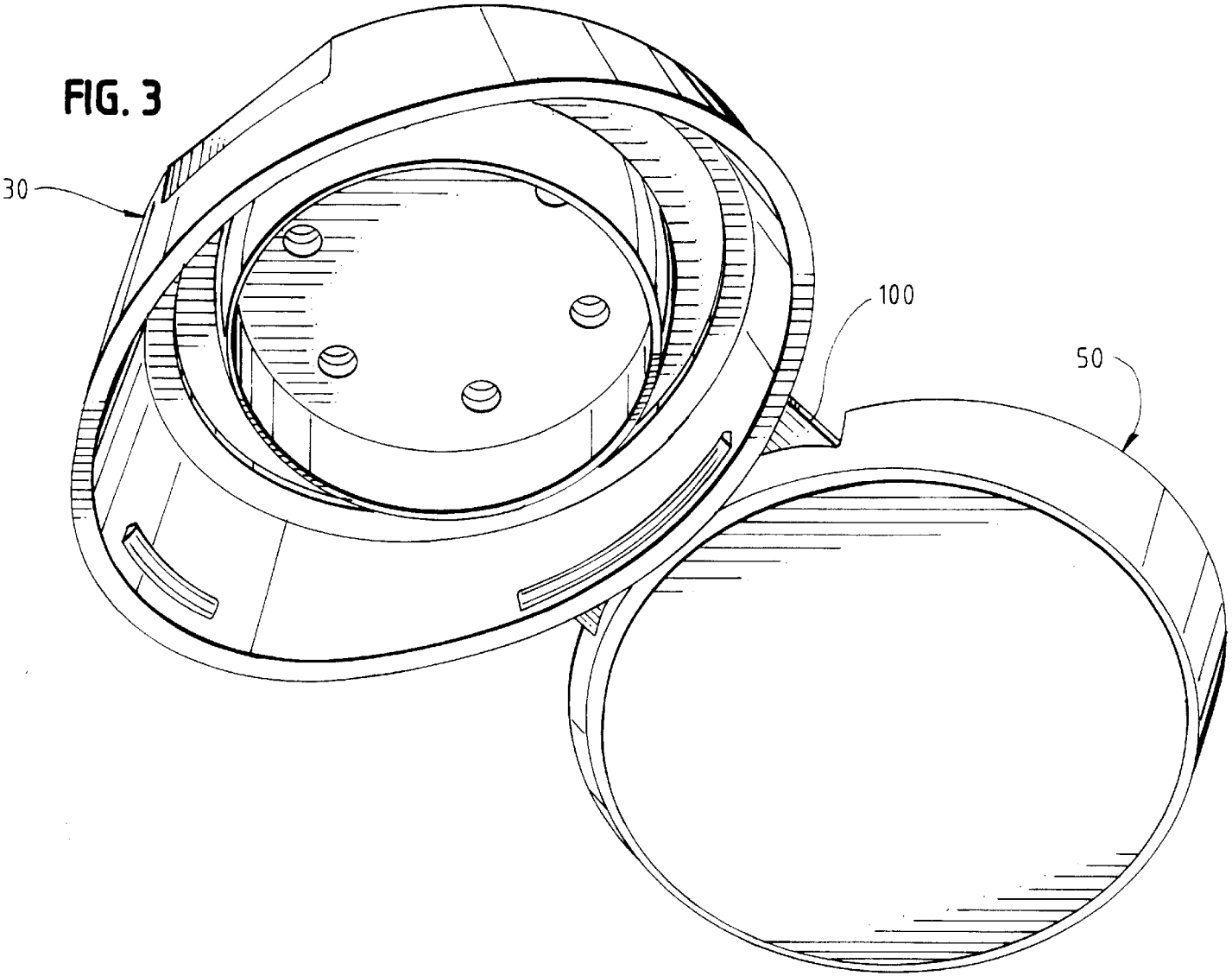
FIG. 3 is a bottom, perspective view of the closure in an open condition.
Figure 4:
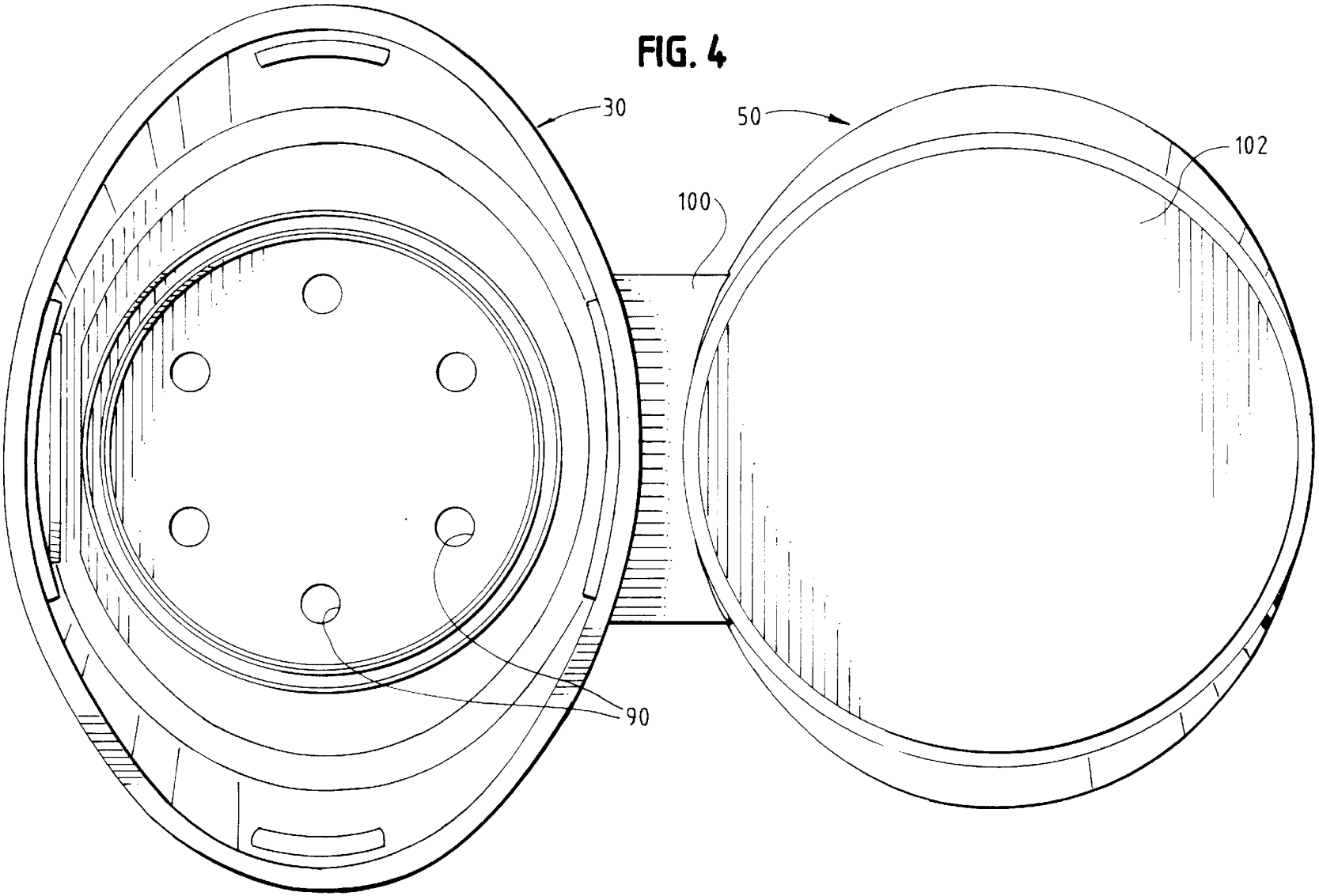
FIG. 4 is a bottom plan view of the open closure.
Figure 5:
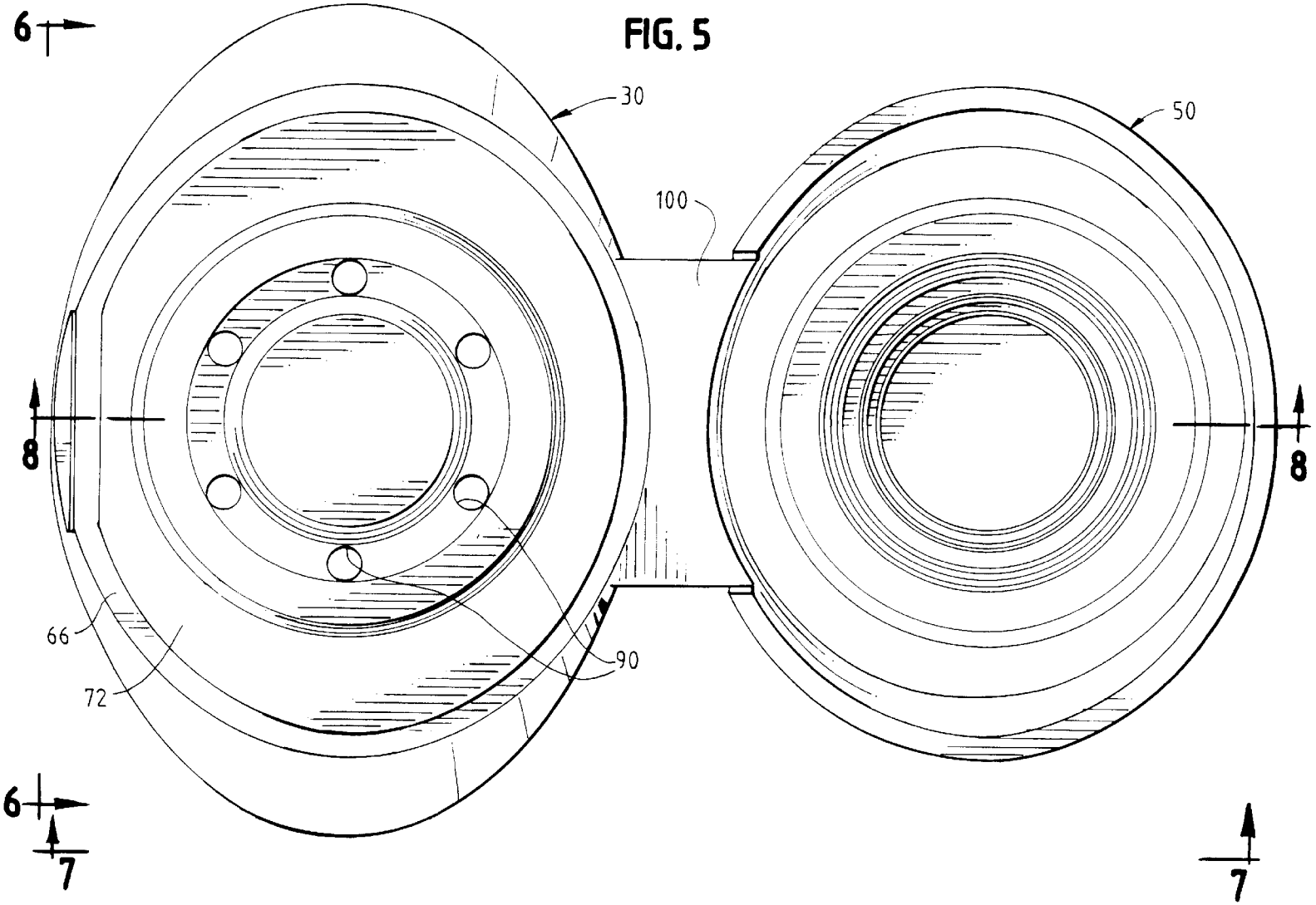
FIG. 5 is a top plan view of the open closure.
Figure 6:
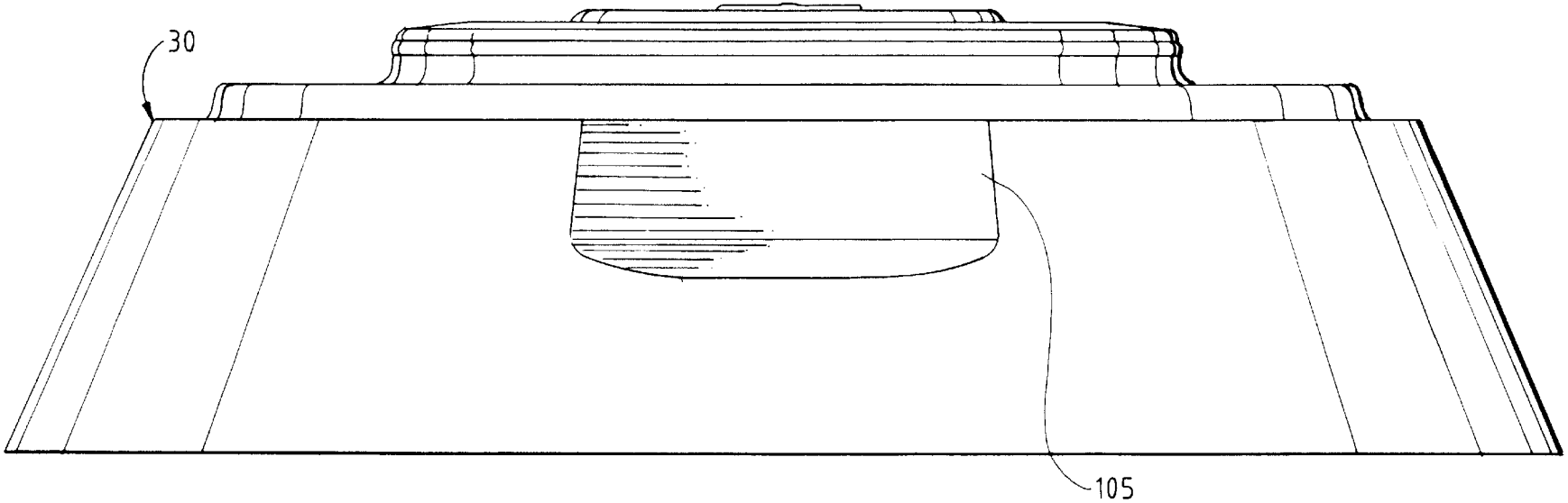
FIG. 6 is a front, elevational view of the open closure taken generally along the plane 6—6 in FIG. 5.
Figure 7:
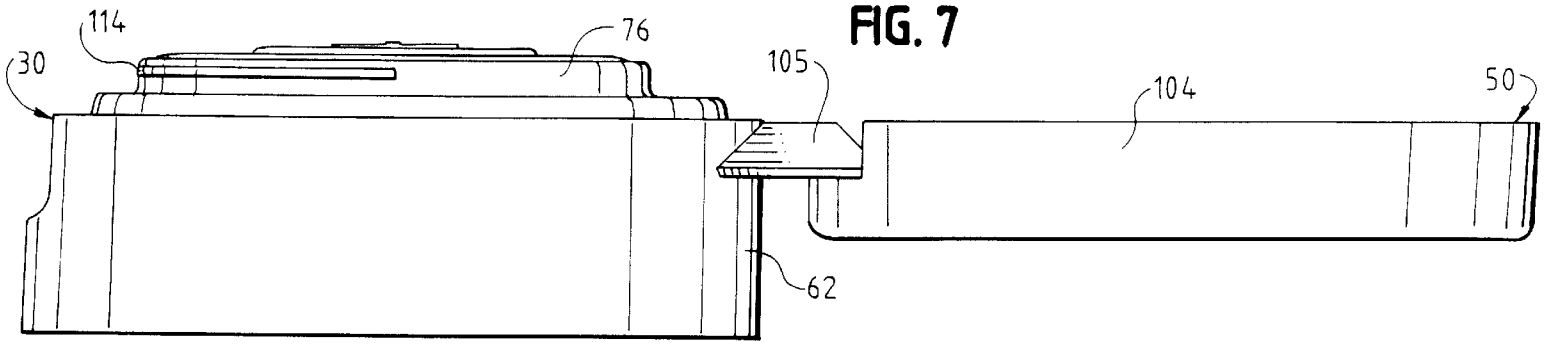
FIG. 7 is a side, elevational view of the open closure taken generally along the plane 7—7 in FIG. 5.

As shown in FIG. 2, the preferred embodiment closure or dispensing structure 20 of the present invention includes a base portion or body 30 and a lid 50. As illustrated in FIG. 8 for the preferred embodiment of the dispensing structure 20, the body 30 may be characterized as having or defining a skirt 62 for receiving the upper end of the container 22. The skirt 62 includes suitable connecting means, such as conventional snap-fit beads 64 adapted to be threadingly engaged with a mating container groove 65. The closure body 30 and container 22 could also be attached with either a dual snap-fit bead engagement or a mating thread engagement.

Also, the closure body 30 could be permanently fixed to the container 22 by means of induction melting, ultrasonic melting, gluing, or the like, depending upon the materials used for the closure body 30 and container 22. As previously mentioned, the closure body could also be formed as a unitary part, or extension, of the container 22.

Figure 9:
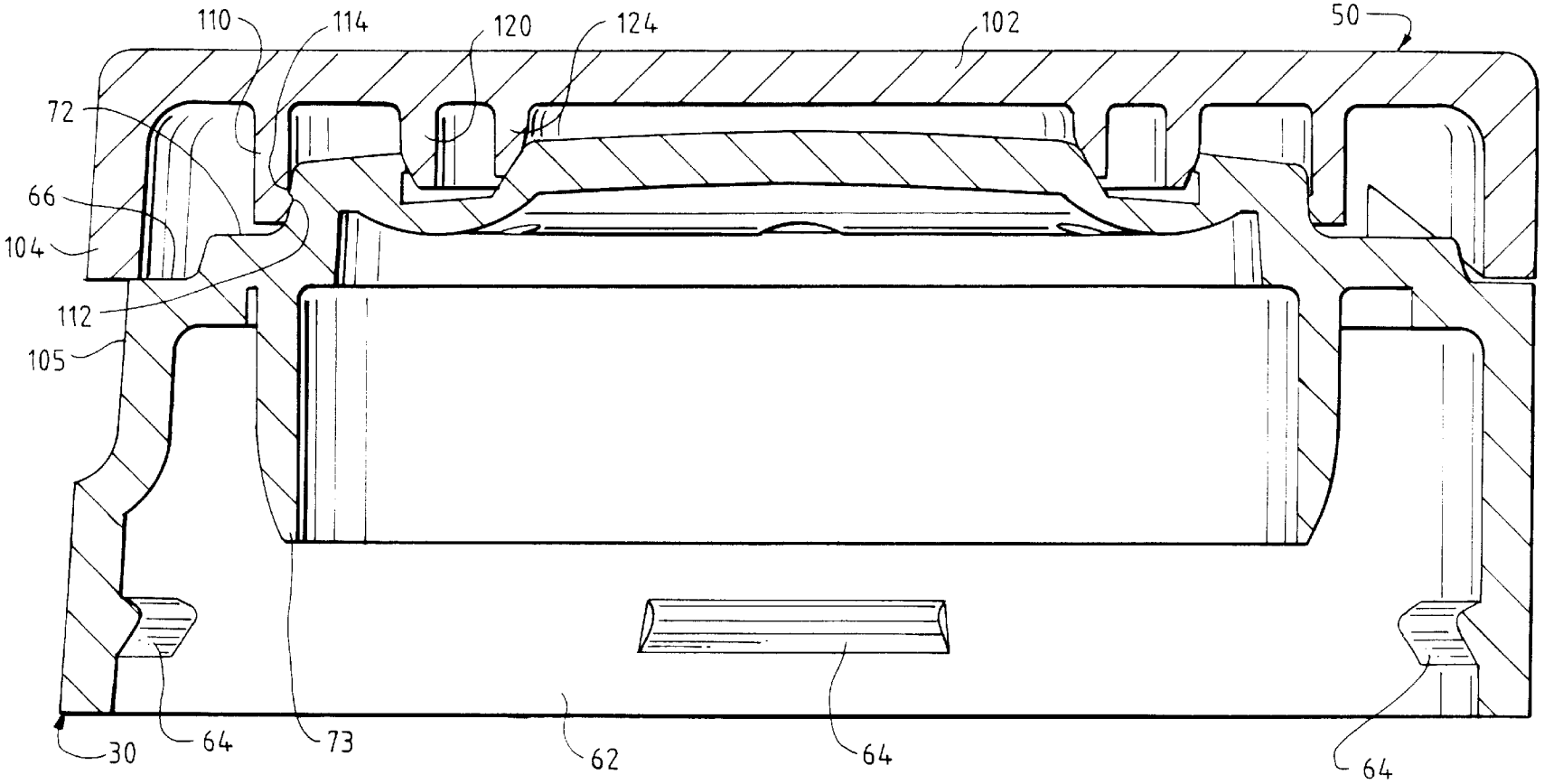
FIG. 9 is an enlarged, cross-sectional view of the closed closure taken along the plane 9—9 of FIG. 1.
Figure 10:
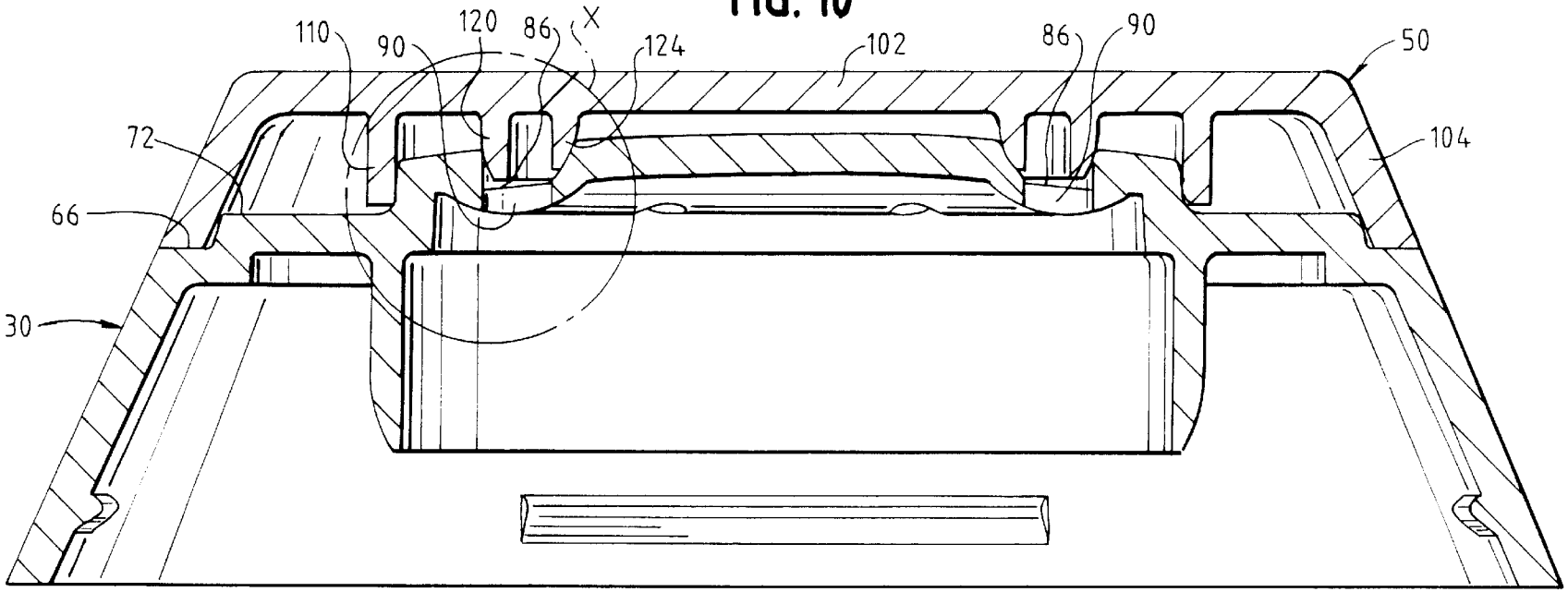
FIG. 10 is an enlarged, cross-sectional view of the closed closure taken along the plane 10—10 in FIG. 1.

As illustrated in FIGS. 8 and 9, the top of the closure body 30 defines a peripheral deck 66 for limiting the closing movement of the lid 50. The deck 66 may be characterized as the upper, end surface of the closure body skirt 62. As can be seen in FIG. 8, the closure body 30 includes an upper end wall 70 which is formed as a unitary extension of the closure body deck 66. The end wall 70 includes an outer shoulder 72 projecting upwardly from the peripheral deck 66. The end wall 70 further includes a raised central portion 74 which projects above the shoulder 72 and which defines a radially outwardly facing peripheral surface 66.

Projecting downwardly from the underside of the end wall shoulder 72 is an annular plug seal 73. The plug seal 73 is adapted to be received inside of the opening 23 at the upper end of the container 22 when the closure body 30 is properly mounted on the container 22 (FIG. 8). The plug seal 73 sealingly engages an inner edge or inner surface of the container 22 to prevent the contents of the container from leaking or flowing into the annular volume adjacent the inside of the closure body skirt 62.

As shown in FIG. 8, the closure body end wall raised central portion 74 defines a continuous channel 80 which has a generally annular configuration. The channel 80 is defined in the end wall raised central portion 74 at least in part by an outer seal surface 82 and an inner seal surface 84 which is spaced inwardly from the outer seal surface 82.

The bottom of the channel 80 is defined by a generally annular bottom wall 86 as shown in FIGS. 2 and 8. Further, as shown in FIG. 2, the channel bottom wall 86 defines a plurality of spaced-apart dispensing apertures 90 between the channel outer seal surface 82 and the channel inner seal surface 84. The apertures 90 communicate through the bottom wall 86 of the closure body end wall 70 with the interior of the closure body 30. Hence, when the closure body 30 is mounted on the end of the container 22, the apertures 90 are in communication with the product held within the container 22.

Figure 11:
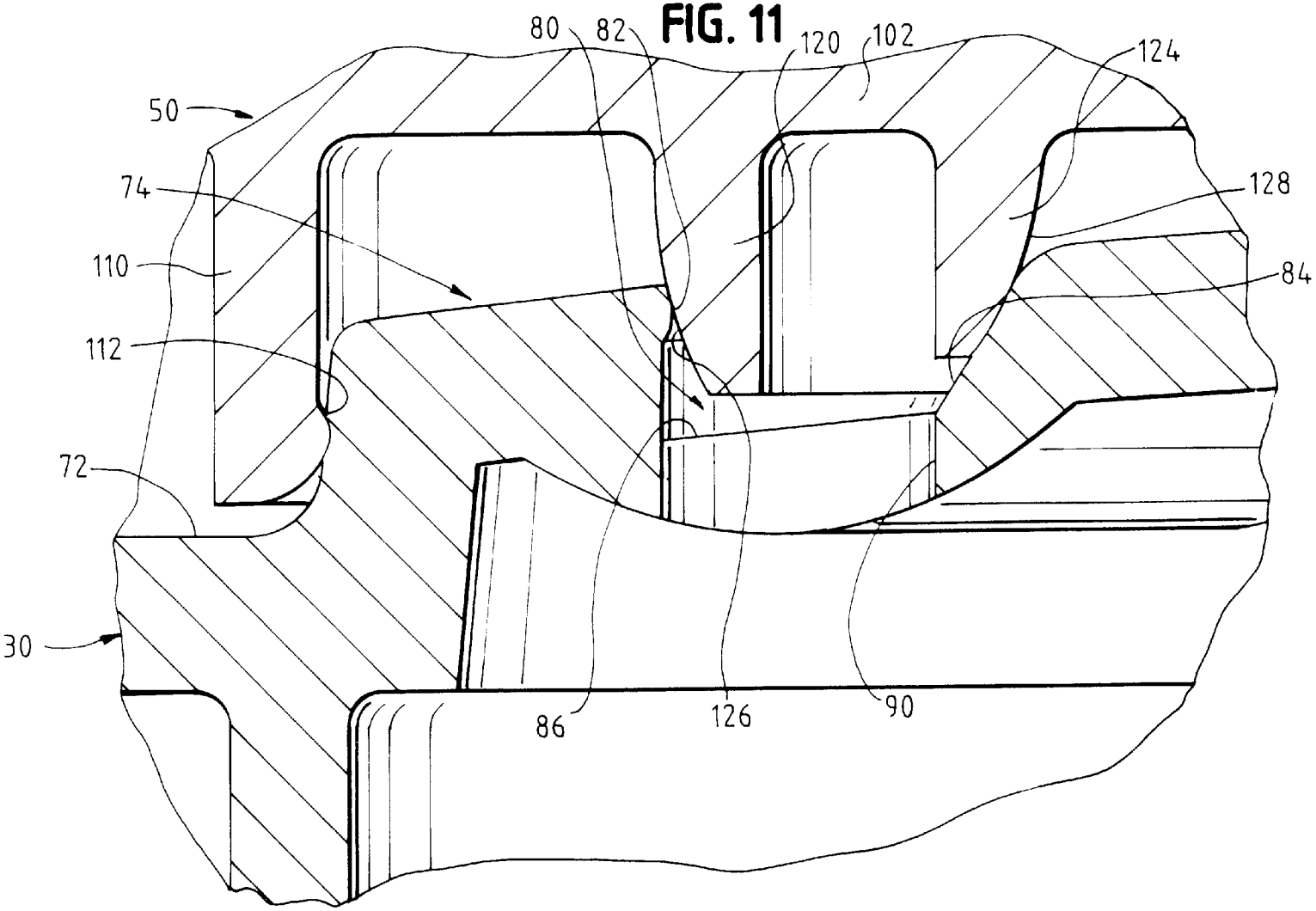
FIG. 11 is an enlarged, greatly enlarged view of the region of the closure shown in FIG. 10 within the circle designated X.

As can be seen in FIG. 11, the closure body end wall channel 80 preferably has a novel sealing system defined by the outer seal surface 82 and the inner seal surface 84. The outer seal surface 82 is in the form of a continuous, radially inwardly projecting seal bead having a transverse cross-sectional configuration of a semicircle (as can best be seen in FIG. 7). The inner seal surface 84 has a generally frustoconical configuration. The configurations of the outer seal surface 82 and inner seal surface 84 are particularly well suited for establishing a seal with the lid 50 when the lid is closed.

The lid 50 may be completely separate from the closure body 30. However, preferably the lid 50 is connected to the closure body 30 with a suitable hinge 100 (FIG. 2). One preferred hinge is the snap-action hinge disclosed in the U.S. Pat. No. 5,642,824. Preferably, such a snap-action hinge provides a bi-stable action for maintaining the lid in a substantially closed position (FIG. 1) or in a substantially open position (FIG. 2).

The lid 50 includes a generally planar, central cover portion 102 (FIG. 8) surrounded by a peripheral skirt 104. The skirt 104 is adapted to limit the lid movement to the closed position by engaging the body deck 66 outwardly of the shoulder 72. The front of the lid 50 overhangs a notch 105 in the body skirt 62. When the lid 50 is closed, the user can insert the end of a thumb or finger under the lid skirt 104 at the closure body notch 105. The user can then push upwardly to lift the lid 50 to an open position.

As shown in FIGS. 2 and 9, the lid 50 includes an annular collar 110 projecting downwardly from the underside of the lid cover portion 102. The collar 110 includes a radially inwardly projecting bead 112 (FIGS. 8 and 11). When the lid 50 is closed, the lid bead 112 engages an outwardly radially extending lip 114 (FIG. 7) which is defined on the front half of the closure body raised central portion peripheral surface 76. The lid collar bead 112 effects a snap-fit engagement with the closure body lip 114 to hold the lid 50 in the closed configuration.

The lid 50 also includes an outer seal wall 120 and an inner seal wall 124 as shown in FIGS. 2 and 8. The seal walls 120 and 124 project downwardly from the underside of the lid cover portion 102. As can be seen in FIG. 11, the outer seal wall 120 has an arcuate sealing surface 126 facing generally radially outwardly. The inner seal wall 124 has an arcuate sealing surface 128 facing generally radially inwardly.

The outer seal wall sealing surface 126 is adapted to sealingly engage the closure body outer seal surface 82. The lid inner seal wall arcuate sealing surface 128 is adapted to sealing engage the closure body inner seal surface 84 when the lid 50 is closed (FIG. 11).

When the lid 50 is closed, the container product cannot be dispensed owing to the sealing engagement between the lid sealing walls 120 and 124 with the body outer seal surface 82 and body inner seal surface 84, respectively.

When the lid 50 is open, the container 22 can be inverted to dispense the container product through the apertures 90. When the container 90 is returned to an upright orientation, some of the product may settle in the closure body annular channel 80 on top of the bottom wall 86 between the apertures 90. However, after the lid 50 is closed, such material is prevented from moving outside of the channel 80 by the lid outer seal wall 120 and lid inner seal wall 124. Thus, very little, if any, of the product will be lodged on the exterior surface of the closure body raised central portion 74. Hence, when the lid 50 is re-opened, there will be very little, if any, material on the upper surface of the raised central portion 74 that could look messy and/or be flung outwardly as the lid 50 is raised. Further, because substantially all of the container product will be below the sealing surfaces (body seal surface 82 and lid surface 126, and body seal surface 84 and lid surface 128 in FIG. 11), the material will stay sealed from ambient atmosphere and remain fresher.

Because the seal walls 120 and 124 each has a continuous, closed configuration, and because the walls 120 and 124 are designed to enter into the single channel 80 together, the closure lid 50 can be readily closed without having to maintain exceptionally close tolerances and alignments. For example, in prior art closures wherein a plurality of plugs project downwardly from the underside of the lid, each of the plugs must enter into a separate dispensing hole. In order to insure that all of the plugs properly enter into the holes, proper alignment between the lid and the closure body must be maintained, and such alignment may be difficult to maintain without relatively massive hinge structures or alignment structures that would necessarily increase the difficulty and cost of manufacture.

In contrast, in the present invention, the seal walls 120 and 124 can be configured to provide relatively flexible or deformable structures which readily enter into the channel 80, and the manufacturing tolerances may be greater. Further, the seal walls 120 and 124 provide exceptional sealing, especially in conjunction with the illustrated preferred configuration of the closure body seal surfaces 82 and 84.

The use of the outer seal wall 120 and inner seal wall 124 in the lid 50, in conjunction with the closure body channel 80, allows the dispensing apertures 90 to have a variety of different configurations. The apertures 90 may be generally cylindrical bores as illustrated. Alternatively, the apertures 90 may have other shapes, such as a square shape, a star shape, etc. Indeed, in a given closure, each aperture 90 could have a different shape. The apertures could, for example, be formed as letters or numbers in the channel 80 so as to provide specific indicia setting forth product identification, advertising, or other messages.

The lid sealing walls, especially the outer sealing wall 120, may be utilized to provide a resistance to opening and closing. This may be employed as an adjunct to, or instead of, the lid body latch feature described above with reference to the lid bead 112 and body rib 114 (FIG. 9). However, in the illustrated, preferred embodiment, the lid sealing walls 120 and 124 are not employed to establish a lid/body latching feature. Thus, the engagement of the lid sealing walls 120 and 124 with the closure body raised central portion 74 can be effected with reduced engagement forces so as to minimize the forces that may be required to close the lid 50 and to open the lid 50. As a result, the lid latching force during closing, and the lid unlatching force during opening, can be more precisely designed as a function of the specific latching structures (e.g., the lid bead 112 and closure body rib 114 (FIG. 9)).

It will also be appreciated that the closure of the present invention can be embodied in a design, such as the preferred design illustrated in FIGS. 1–11, wherein the closure body material in the orifice area has a more uniform material thickness, and this simplifies the thermoplastic molding process.

It is presently contemplated that many applications employing the dispensing structure 20 will be most conveniently realized by molding the dispensing structure 20 from suitable thermoplastic material or materials. In the preferred embodiment illustrated, the body 30, hinge 100, and lid 50 are preferably molded as a unitary structure from a suitable thermoplastic material such as polypropylene.

It will also be appreciated that the dispensing structure 20 can be readily designed to incorporate appropriate tamper-evident features and/or child-resistant features. Such features may be incorporated within the structure of the closure body and lid and/or may include overcap structures or shrink film systems (not illustrated).

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing structure for a container that has an opening to the container interior, said dispensing structure comprising:

(A) a body for extending around said container opening and having
  (1) an end wall,
  (2) a continuous channel defined in said end wall at least in part by an outer seal surface and an inner seal surface spaced from said outer seal surface, said channel being outwardly open and having a bottom wall, and
  (3) a plurality of spaced-apart dispensing apertures in said channel between said outer and inner seal surfaces; and (B) a lid with a continuous outer seal wall and a continuous inner seal wall spaced from said outer seal wall, said lid being movable between (1) a closed position over said body end wall wherein said outer seal wall sealingly engages said body outer seal surface and said inner seal wall sealingly engages said body inner seal surface, and (2) an open position spaced from said closed position.

2. The dispensing structure in accordance with claim 1 in which said dispensing structure is a closure for an end of said container which defines said opening.

3. The dispensing structure in accordance with claim 2 in which said closure is an article formed separately from said container; and said closure body is removably attachable to said container end.

4. The dispensing structure in accordance with claim 2 in which said closure is a unitary part of said container; and said body extends from said container as a unitary part of said container end.

5. The dispensing structure in accordance with claim 1 in which said body channel has a generally circular configuration.

6. The dispensing structure in accordance with claim 1 in which said body includes a peripheral deck for limiting the movement of said lid to said closed position.

7. The dispensing structure in accordance with claim 1 in which said dispensing structure further includes a hinge connecting said lid with said body.

8. The dispensing structure in accordance with claim 7 in which said hinge is a bi-stable, snap-action hinge.

9. The dispensing structure in accordance with claim 1 in which said body outer seal surface includes a radially inwardly projecting seal bead.

10. The dispensing structure in accordance with claim 1 in which said body inner seal surface has a frustoconical configuration.

11. The dispensing structure in accordance with claim 1 in which said lid outer seal wall has an arcuate sealing surface facing generally radially outwardly.

12. The dispensing structure in accordance with claim 1 in which said lid inner seal wall has an arcuate sealing surface facing generally radially inwardly.

13. A dispensing structure for a container that has an opening to the container interior, said dispensing structure comprising:

(A) a body for extending around said container opening and having (1) an end wall, (2) a continuous channel defined in said end wall at least in part by an outer seal surface and an inner seal surface spaced from said outer seal surface, and (3) a plurality of spaced-apart dispensing apertures in said channel between said outer and inner seal surfaces; and (B) a lid with a continuous outer seal wall and a continuous inner seal wall spaced from said outer seal wall, said lid being movable between (1) a closed position over said body end wall wherein said outer seal wall sealingly engages said body outer seal surface and said inner seal wall sealingly engages said body inner seal surface, and (2) an open position spaced from said closed position, and wherein said body end wall further includes a raised central portion with a radially outwardly facing peripheral surface; and said lid includes a collar for encompassing said body raised central portion so that said raised central portion peripheral surface is adjacent said collar when said lid is in said closed position.

14. The dispensing structure in accordance with claim 13 in which said lid collar and said raised central portion peripheral surface of said body each includes a lip for effecting a snap-fit latch when said lid is in said closed position.

15. A dispensing structure for a container that has an opening to the container interior, said dispensing structure comprising:

(A) a body for extending around said container opening and having (1) an end wall, (2) a continuous channel defined in said end wall at least in part by an outer seal surface and an inner seal surface spaced from said outer seal surface, said channel being outwardly open and having a bottom wall, said body outer seal surface including a radially inwardly projecting seal bead, said body inner seal surface having a frustoconical configuration, and (3) a plurality of spaced-apart dispensing apertures in said channel between said outer and inner seal surfaces; and (B) a lid hinged to said body and having a continuous outer seal wall and a continuous inner seal wall spaced from said outer seal wall, said lid outer seal wall having an arcuate sealing surface facing generally radially outwardly, said lid inner seal wall having an arcuate sealing surface facing generally radially inwardly, said lid being movable between (1) a closed position over said body end wall wherein said outer seal wall sealingly engages said body outer seal surface and said inner seal wall sealingly engages said body inner seal surface, and (2) an open position spaced from said closed position.

16. The dispensing structure in accordance with claim 15 in which said dispensing structure is a closure for an end of said container which defines said opening.

17. The dispensing structure in accordance with claim 16 in which said closure is an article formed separately from said container; and said closure body is removably attachable to said container end.

18. The dispensing structure in accordance with claim 16 in which said closure is a unitary part of said container; and said body extends from said container as a unitary part of said container end.

19. The dispensing structure in accordance with claim 15 in which said body channel has a generally circular configuration.

20. The dispensing structure in accordance with claim 15 in which said body includes a peripheral deck for limiting the movement of said lid to said closed position.

* * * * *